United States Patent [19]

Reed et al.

[11] 4,314,020

[45] Feb. 2, 1982

[54] COLOR TRANSFERS ASSEMBLAGES WITH TWO TIMING LAYERS AND A NEUTRALIZING LAYER

[75] Inventors: Kenneth J. Reed; Patrick H. Saturno, both of Rochester; Gerald L. Ducharme, Naples, all of N.Y.

[73] Assignee: Eastman Kodak Company, Rochester, N.Y.

[21] Appl. No.: 175,224

[22] Filed: Aug. 4, 1980

[51] Int. Cl.[3] ..... G03C 7/00; G03C 5/54; G03C 1/40

[52] U.S. Cl. ..... 430/215; 430/218; 430/214; 430/219; 430/523; 430/564; 430/212; 430/536

[58] Field of Search ..... 430/212, 218, 215, 523, 430/564, 536, 214

[56] References Cited

U.S. PATENT DOCUMENTS

| | | | |
|---|---|---|---|
| 3,706,557 | 12/1972 | Arond | 96/29 |
| 3,779,756 | 12/1973 | Farran et al. | 96/29 |
| 4,009,029 | 2/1977 | Hammond et al. | 96/3 |
| 4,056,394 | 11/1977 | Hannie | 96/29 |
| 4,061,496 | 12/1977 | Hannie et al. | 96/29 |
| 4,190,447 | 2/1980 | Coil et al. | 430/214 |
| 4,229,516 | 10/1980 | Abel | 430/215 |

FOREIGN PATENT DOCUMENTS

| | | |
|---|---|---|
| 866206 | 10/1978 | Belgium . |
| 2847637 | 5/1979 | Fed. Rep. of Germany . |
| 2388307 | 11/1978 | France . |
| 1505699 | 3/1978 | United Kingdom . |
| 2019392 | 4/1979 | United Kingdom . |

OTHER PUBLICATIONS

Research Disclosure, 1979, Item No. 18452.

U.S. Application Ser. No. 948,062 of Abel, filed 10/2/78.

U.S. Application Ser. No. 933,399 of Popp et al., filed 8/14/78.

*Primary Examiner*—Richard L. Schilling

*Assistant Examiner*—John L. Goodrow

*Attorney, Agent, or Firm*—Harold E. Cole

[57] ABSTRACT

Photographic assemblages, elements, receiving elements and cover sheets comprise a combination of two timing layers and a neutralizing layer. The outermost timing layer contains photographic addenda, such as development inhibitors, for substantially terminating development of the silver halide emulsion. The timing layer next to the neutralizing layer has a much longer breakdown time so that it is permeated by the alkaline processing composition only after silver halide development has been substantially terminated.

29 Claims, No Drawings

COLOR TRANSFERS ASSEMBLAGES WITH TWO TIMING LAYERS AND A NEUTRALIZING LAYER

This invention relates to photography, and more particularly to photographic assemblages, elements, receiving elements and cover sheets for color diffusion transfer photography wherein a combination of two timing layers is employed along with a neutralizing layer. The outermost timing layer contains photographic addenda for substantially terminating development, while the innermost timing layer breaks down only after development has been substantially terminated. The assemblage is then neutralized by the neutralizing layer.

Various formats for color, integral transfer elements are described in the prior art, such as U.S. Pat. Nos. 3,415,644; 3,415,645, 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 minutes or more in other formats. Since development occurs at a high pH, it is stopped by merely lowering the pH. The use of a neutralizing layer, such as a polymeric acid, can be employed for this purpose, which will stabilize the element after the required diffusion of dyes has taken place. A timing layer is usually employed in conjunction with the neutralizing layer, so that the pH is not prematurely lowered, which would stop development. The development time is thus established by the time it takes the alkaline composition to penetrate through the timing layer. As the system stats to become stabilized, alkali is depleted throughout the structure, causing silver halide development to cease in response to this drop in pH. For each image generating unit, this shutoff mechanism establishes the amount of silver halide development and the related amount of dye formed according to the respective exposure values.

U.S. Pat. No. 4,061,496 relates to a combination of two timing layers in various photographic elements. These timing layers are characterized by having a certain activation energy of penetration by an aqueous alkaline solution. One or more of these timing layers is useful in a preferred embodiment of our invention as the first timing layer, provided that it contains photographic addenda for terminating development of the silver halide emulsion.

U.S. Pat. No. 3,706,557 relates to the use of a temporary barrier layer in a photographic film unit to prevent migration of a development restrainer from a positive component to a negative component during storage, but permits such migration upon processing. The temporary barrier layer and timing layer in that patent, however, function differently than the combination of timing layers in our invention, where the innermost timing layer is permeated by alkaline processing composition only after silver halide development has been substantially terminated.

U.S. patent application Ser. No. 948,062 of Abel, filed Oct. 2, 1978, now U.S. Pat. No. 4,229,516, issued Oct. 21, 1980, relates to the use of a particular polymeric timing layer in color image transfer film units. This timing layer is useful as the second timing layer in our invention in a preferred embodiment thereof.

The use of development restrainers or precursors in diffusion transfer film units are disclosed, for example, in British Patent Application No. 2,019,392A, U.S. Pat. No. 4,009,029, and British Pat. No. 1,505,699. The use of such compounds in a combination of timing layers as described herein is not disclosed in these references, however.

U.S. Pat. No. 4,190,447 relates to the use of an alkali-permeable hydrophilic layer over a barrier timing layer on a cover sheet. These timing layers, however, have different functions than the timing layers of this invention.

U.S. patent application Ser. No. 933,399 of Popp et al, filed Aug. 14, 1978, relates to a bleach-fix cover sheet comprising a silver bleaching agent, a silver salt fixing agent and a hydrophilic binder. Our combination of timing layers, however, is not disclosed in this patent application.

While prior art shutdown mechanisms based on pH reduction have worked reasonably well, there is room for improvement. For example, post process diffusion (PPD) of dyes is an undesirable buildup of dye density which sometimes occurs even after the system is supposedly shut down. It results in an undesirable increase in $D_{min}$. In a system employing sulfonamidonaphthol imaging chemistry, for example, reducing the pH of the film unit tends to adversely affect the rates of quinonimide deamidation and released dye diffusion. It would be desirable to have an alternative shutdown mechanism for a diffusion transfer system which would eliminate or improve the PPD problem.

We have found that a particular combination of timing layers according to our invention provides significant PPD advantages. The outermost or first timing layer "breaks down" or is permeated by alkaline processing composition in a relatively short time—three minutes, for example—and releases photographic addenda for substantially terminating silver halide development. The innermost or second timing layer has a much longer breakdown time—on the order of 10 or 20 minutes, for example. The alkaline processing composition, therefore, cannot reach the neutralizing layer until after that time. The system thus remains at a high pH for a comparatively long time. Less dye aggregation is obtained in this system, since dyes diffuse faster at high pH. Our system also provides excellent $D_{min}$ control and good incubation stability.

A photographic assemblage in accordance with our invention comprises:

(a) a photographic element comprising a support having thereon at least one photosensitive silver halide emulsion layer having associated therewith a dye image-providing material;

(b) a dye image-receiving layer;

(c) a neutralizing layer for neutralizing an alkaline processing composition;

(d) a first timing layer located between the neutralizing layer and the photosensitive silver halide emulsion layer; and (e) a second timing layer located between the first timing layer and the neutralizing layer;

the first and second timing layers being so located that the processing composition must first permeate the timing layers before contacting the neutralizing layer, the neutralizing layer being located on the side of the second timing layer which is farthest from the dye image-receiving layer, and wherein:

(i) the first timing layer contains photographic addenda for substantially terminating development of the silver halide emulsion layer; and (ii) the second timing layer being capable of being permeated by the alkaline processing composition only after the silver halide development has been substantially terminated.

Various types of photographic addenda are used in the first timing layer according to our invention for substantially terminating development of the silver halide emulsion. Useful materials include, for example, development inhibitors, silver halide fixing agents or competing developers. These compounds are used in any concentration which is effective to produce the intended result. In a preferred embodiment of our invention, we have obtained good results using development inhibitors.

Any development inhibitor is useful in our invention, as long as it will substantially terminate development of the silver halide emulsion. Useful compounds include, for example, nitrogen-containing heterocyclic compounds such as: benzotriazoles, benzimidazoles and imidazoles, and substituted or unsubstituted heterocyclic thiols, such as: mercaptothiazoles, mercaptooxazoles, mercaptodiazoles, mercaptothiadiazoles, mercaptopyrimidines, mercaptobenzoxazoles, mercaptobenzimidazoles, or mercaptotetrazoles. Specific examples of such compounds include: 1-phenyl-5-mercaptotetrazole, benzotriazole, 5-methyl-benzotriazole, 2-benzimidazolethiol, 5-nitrobenzimidazole, 6-nitroindazole, 2-mercaptobenzoxazole, 5-acetyl-2-benzoylthio-4-methyltriazole, or 4-hydroxymethyl-4-thiazoline-4-thione. These compounds are used in concentrations of from about 50 to about 1,000 mg per square meter of element. The compounds are incorporated as solutions, as fine particulate dispersions or dissolved in droplets of a high boiling solvent.

Any material is useful as the first timing layer in our invention, provided it has the desired function and contains photographic addenda as described above. Suitable materials are disclosed, for example, on pages 22 and 23 of the July, 1974 edition of *Research Disclosure*, pages 35 through 37 of the July, 1975 edition of *Research Disclosure, U.S. Pat. Nos.* 4,029,849; 4,061,496 and 4,190,447, the disclosures of which are hereby incorporated by reference. As noted above, the breakdown time for this timing layer is relatively short, for example, from 2 to 6 minutes, preferably from 3 to 4 minutes.

The second timing layer of our invention is formed out of any of those materials described above for the first timing layer, provided its permeability is such that it cannot be permeated by the alkaline processing composition only until after silver halide development has been substantially terminated. This is achieved by selecting a material having this inherent property, by varying the thickness of the layer, by employing various hardeners for the layer, etc. As noted above, the breakdown time for this timing layer is relatively long, for example, from about 7 to about 20 minutes. In a preferred embodiment of the invention, the second timing layer has an activation energy of penetration of the layer by an aqueous alkaline solution of greater than 18 kcal/mole and comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone. This preferred material is more fully described in Abel U.S. Pat. No. 4,229,516, issued Oct. 21, 1980. Such polymeric carboxy-ester-lactones comprise, for example, in a preferred embodiment, the following recurring structural

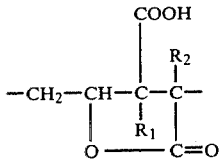

and

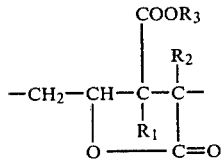

wherein:

$R_3$ is alkyl having from 1 to about 12 carbon atoms or aralkyl wherein said alkyl comprises from about 1 to about 4 carbon atoms; and $R_1$ and $R_2$ are independently hydrogen or methyl.

In another preferred embodiment, the lactone additionally comprises the following units:

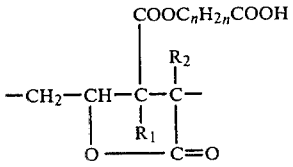

and

United States Patent [19]

Reed et al.

[11] 4,314,020

[45] Feb. 2, 1982

[54] COLOR TRANSFERS ASSEMBLAGES WITH TWO TIMING LAYERS AND A NEUTRALIZING LAYER

[75] Inventors: Kenneth J. Reed; Patrick H. Saturno, both of Rochester; Gerald L. Ducharme, Naples, all of N.Y.

[73] Assignee: Eastman Kodak Company, Rochester, N.Y.

[21] Appl. No.: 175,224

[22] Filed: Aug. 4, 1980

[51] Int. Cl.[3] ..... G03C 7/00; G03C 5/54; G03C 1/40

[52] U.S. Cl. ..... 430/215; 430/218; 430/214; 430/219; 430/523; 430/564; 430/212; 430/536

[58] Field of Search ..... 430/212, 218, 215, 523, 430/564, 536, 214

[56] References Cited

U.S. PATENT DOCUMENTS

| | | | |
|---|---|---|---|
| 3,706,557 | 12/1972 | Arond | 96/29 |
| 3,779,756 | 12/1973 | Farran et al. | 96/29 |
| 4,009,029 | 2/1977 | Hammond et al. | 96/3 |
| 4,056,394 | 11/1977 | Hannie | 96/29 |
| 4,061,496 | 12/1977 | Hannie et al. | 96/29 |
| 4,190,447 | 2/1980 | Coil et al. | 430/214 |
| 4,229,516 | 10/1980 | Abel | 430/215 |

FOREIGN PATENT DOCUMENTS

| | | |
|---|---|---|
| 866206 | 10/1978 | Belgium . |
| 2847637 | 5/1979 | Fed. Rep. of Germany . |
| 2388307 | 11/1978 | France . |
| 1505699 | 3/1978 | United Kingdom . |
| 2019392 | 4/1979 | United Kingdom . |

OTHER PUBLICATIONS

Research Disclosure, 1979, Item No. 18452.

U.S. Application Ser. No. 948,062 of Abel, filed 10/2/78.

U.S. Application Ser. No. 933,399 of Popp et al., filed 8/14/78.

*Primary Examiner*—Richard L. Schilling

*Assistant Examiner*—John L. Goodrow

*Attorney, Agent, or Firm*—Harold E. Cole

[57] ABSTRACT

Photographic assemblages, elements, receiving elements and cover sheets comprise a combination of two timing layers and a neutralizing layer. The outermost timing layer contains photographic addenda, such as development inhibitors, for substantially terminating development of the silver halide emulsion. The timing layer next to the neutralizing layer has a much longer breakdown time so that it is permeated by the alkaline processing composition only after silver halide development has been substantially terminated.

29 Claims, No Drawings tralizing layer, which is located on the side of the second timing layer which is farthest from the dye image-receiving layer, so that the alkaline processing composition is neutralized by means of the neutralizing layer associated with the timing layers after the predetermined times.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separated layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidonone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

In using dye image-providing materials in the invention which produce diffusible dye images as a function of development, either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form pH. Our system also provides excellent $D_{min}$ control and good incubation stability.

A photographic assemblage in accordance with our invention comprises:

(a) a photographic element comprising a support having thereon at least one photosensitive silver halide emulsion layer having associated therewith a dye image-providing material;

(b) a dye image-receiving layer;

(c) a neutralizing layer for neutralizing an alkaline processing composition;

(d) a first timing layer located between the neutralizing layer and the photosensitive silver halide emulsion layer; and (e) a second timing layer located between the first timing layer and the neutralizing layer;

the first and second timing layers being so located that the processing composition must first permeate the timing layers before contacting the neutralizing layer, the neutralizing layer being located on the side of the second timing layer which is farthest from the dye image-receiving layer, and wherein:

(i) the first timing layer contains photographic addenda for substantially terminating development of the silver halide emulsion layer; and (ii) the second timing layer being capable of being permeated by the alkaline processing composition only after the silver halide development has been substantially terminated.

Various types of photographic addenda are used in the first timing layer according to our invention for substantially terminating development of the silver halide emulsion. Useful materials include, for example, development inhibitors, silver halide fixing agents or competing developers. These compounds are used in any concentration which is effective to produce the intended result. In a preferred embodiment of our invention, we have obtained good results using development inhibitors.

Any development inhibitor is useful in our invention, as long as it will substantially terminate development of the silver halide emulsion. Useful compounds include, for example, nitrogen-containing heterocyclic compounds such as: benzotriazoles, benzimidazoles and imidazoles, and substituted or unsubstituted heterocyclic thiols, such as: mercaptothiazoles, mercaptooxazoles, mercaptodiazoles, mercaptothiadiazoles, mercaptopyrimidines, mercaptobenzoxazoles, mercaptobenzimidazoles, or mercaptotetrazoles. Specific examples of such compounds include: 1-phenyl-5-mercaptotetrazole, benzotriazole, 5-methyl-benzotriazole, 2-benzimidazolethiol, 5-nitrobenzimidazole, 6-nitroindazole, 2-mercaptobenzoxazole, 5-acetyl-2-benzoylthio-4-methyltriazole, or 4-hydroxymethyl-4-thiazoline-4-thione. These compounds are used in concentrations of from about 50 to about 1,000 mg per square meter of element. The compounds are incorporated as solutions, as fine particulate dispersions or dissolved in droplets of a high boiling solvent.

Any material is useful as the first timing layer in our invention, provided it has the desired function and contains photographic addenda as described above. Suitable materials are disclosed, for example, on pages 22 and 23 of the July, 1974 edition of *Research Disclosure*, pages 35 through 37 of the July, 1975 edition of *Research Disclosure, U.S. Pat. Nos.* 4,029,849; 4,061,496 and 4,190,447, the disclosures of which are hereby incorporated by reference. As noted above, the breakdown time for this timing layer is relatively short, for example, from 2 to 6 minutes, preferably from 3 to 4 minutes.

The second timing layer of our invention is formed out of any of those materials described above for the first timing layer, provided its permeability is such that it cannot be permeated by the alkaline processing composition only until after silver halide development has been substantially terminated. This is achieved by selecting a material having this inherent property, by varying the thickness of the layer, by employing various hardeners for the layer, etc. As noted above, the breakdown time for this timing layer is relatively long, for example, from about 7 to about 20 minutes. In a preferred embodiment of the invention, the second timing layer has an activation energy of penetration of the layer by an aqueous alkaline solution of greater than 18 kcal/mole and comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone. This preferred material is more fully described in Abel U.S. Pat. No. 4,229,516, issued Oct. 21, 1980. Such polymeric carboxy-ester-lactones comprise, for example, in a preferred embodiment, the following recurring structural

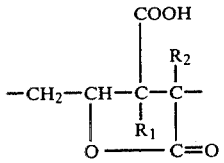

and

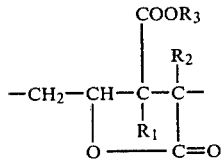

wherein:

$R_3$ is alkyl having from 1 to about 12 carbon atoms or aralkyl wherein said alkyl comprises from about 1 to about 4 carbon atoms; and $R_1$ and $R_2$ are independently hydrogen or methyl.

In another preferred embodiment, the lactone additionally comprises the following units:

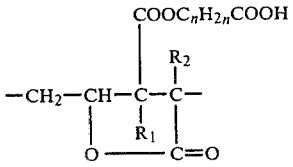

and (C) A cover sheet according to the invention was prepared by coating the following layers, in the order recited, on a poly(ethylene terephthalate) film support (1) an acid layer comprising poly(n-butyl acrylate-co-acrylic acid), (30:70 weight ratio equivalent to 140 meq. acid/$m^2$); and (2) a timing layer comprising 2.6 g/$m^2$ of a 1:1 physical mixture by weight of poly(acrylonitrile-co-vinylidene chloride-co-acrylic acid latex) (weight ratio of 14/79/7) and a lactone polymer, partially hydrolyzed and 1-butanol transesterified poly(vinyl acetate-co-maleic anhydride), ratio of acid/butyl ester 15/85.

(3) gelatin layer (0.54 g/$m^2$); and (4) a timing layer comprising 3.2 g/$m^2$ of a 1:1 physical mixture by weight of poly(acrylonitrile-co-vinylidene chloride-co-acrylic acid latex) (weight ratio of 14/79/7) and a lactone polymer, partially hydrozlyed and 1-butanol transesterified poly(vinyl acetate-co-maleic anhydride), ratio of acid/butyl ester 15/85 containing 43 mg/$m^2$ of t-butylhydroquinone monoacetate, and 108 mg/$m^2$ of 5-(2-cyanoethylthio)-1-phenyl tetrazole.

(D) Another cover sheet according to the invention was prepared similar to (C), except that gelatin interlayer (3) was omitted.

An integral imaging-receiver element was prepared by coating the following layers in the order recited on a transparent poly(ethylene terephthalate) film support. Quantities are parenthetically given in grams per square meter, unless otherwise stated.

(1) image-receiving layer of a poly(divinylbenzene-co-styrene-co-N-benzyl-N,N-dimethyl-N-vinylbenzyl) ammonium sulfate (1/49.5/49.5) latex mordant (2.3) and gelatin (2.3);

(2) reflecting layer of titanium dioxide (16.2) and gelatin (2.6);

(3) opaque layer of carbon black (1.9), gelatin (1.2), oxidized developer scavenger 2-(2-octadecyl)-5-sulfohydroquinone potassium salt (0.03) and cyan RDR A (0.02) dispersed in N-n-butylacetanilide;

(4) cyan dye-providing layer of gelatin (0.65) and cyan RDR B (0.38) dispersed in N-n-butylacetanilide;

(5) interlayer of gelatin (0.54);

(6) red-sensitive, direct-positive silver bromide emulsion (0.91 silver), gelatin (0.91), Nucleating Agent A (125 mg/Ag mole), 2-(2-octadecyl)-5-sulfohydroquinone potassium salt (0.17) and Nucleating Agent B (6.6 mg/Ag mole);

(7) interlayer of gelatin (1.2) and 2,5-di-sec-dodecylhydroquinone (0.81);

(8) magenta dye-providing layer of magenta RDR C (0.34) dispersed in diethyllauramide) and gelatin (0.68);

(9) green-sensitive, direct-positive silver bromide emulsion (0.91 silver), gelatin (0.91), Nucleating Agent A (140 mg/Ag mole), Nucleating Agent B (1.3 mg/Ag mole), and 2-(2-octadecyl)-5-sulfohydroquinone potassium salt (0.17);

(10) interlayer of gelatin (1.2) and 2,5-di-sec-dodecylhydroquinone (0.97);

(11) interlayer of gelatin (0.55);

(12) yellow dye-providing layer of yellow RDR D (0.57) dispersed in di-n-butyl phthalate and gelatin (0.97);

(13) blue-sensitive, direct positive silver bromide emulsion (0.91 silver), gelatin (0.91), Nucleating Agent A (96 mg/Ag mole), Nucleating Agent B (1.1 mg/Ag mole), and 2-(2-octadecyl)-5-sulfohydroquinone potassium salt (0.17); and

(14) overcoat layer of gelatin (0.89) and 2,5-di-sec-dodecylhydroquinone (0.11).

The direct-positive emulsions are approximately 0.8$\mu$ monodispersed, octahedral, internal image silver bromide emulsions, as described in U.S. Pat. No. 3,923,513.

CYAN RDR A

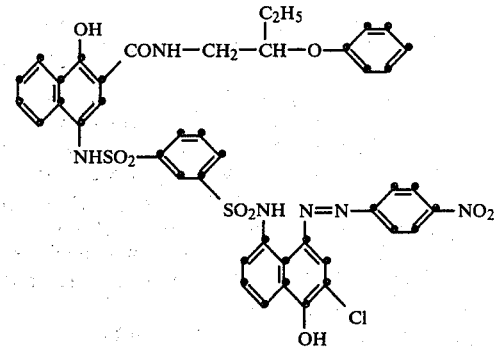

CYAN RDR B

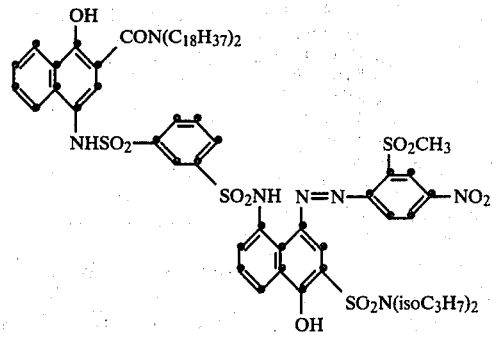

MAGENTA RDR C

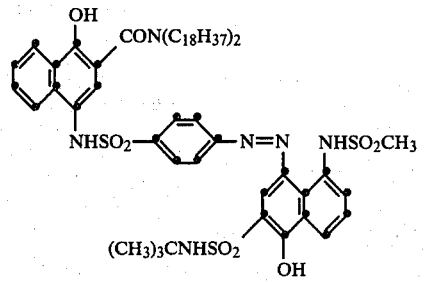

YELLOW RDR D

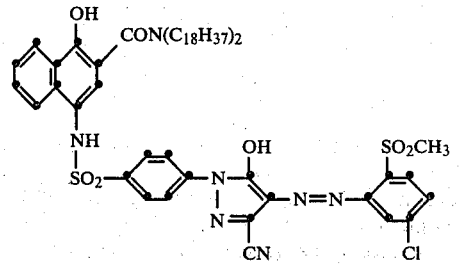

Nucleating Agent A

-continued

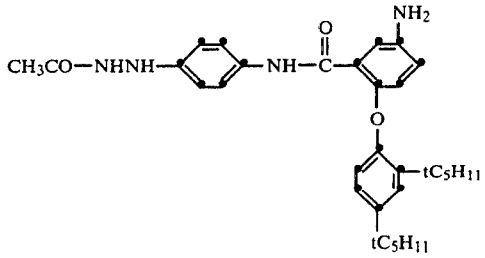

Nucleating Agent B

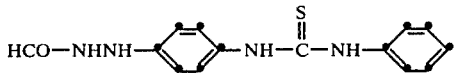

Samples of the imaging-receiver element were exposed in a sensitometer through a graduated density test object. The exposed samples were then processed at 21° C. by rupturing a pod containing the viscous processing composition described below between the imaging-receiver element and the cover sheets described above, by using a pair of juxtaposed rollers to provide a processing gap of about 65 μm.

The processing composition was as follows:

| | |
|---|---|
| 46.8 g | potassium hydroxide |
| 7 g | 4,4'-dimethyl-4-hydroxymethyl-1-phenyl-3-pyrazolidinone |
| 1.5 g | 1,4-cyclohexanedimethanol |
| 4 g | 5-methylbenzotriazole |
| 1 g | sodium sulfite |
| 6.4 g | Tamol SN® dispersant |
| 10 g | potassium fluoride |
| 66.8 g | carboxymethylcellulose |
| 171 g | carbon |
| | water to 1 liter |

The red, green and blue densities of the resulting image are read after three hours. The densities of the same imaging element are read again after 72 hours (dark keeping at room temperature). The difference in density at D-max (maximum density) is a measure of the post-process dye diffusion. The following results were obtained:

by producing "toes" which are too soft and higher D-min's.

EXAMPLE 2

Post Process Dye Density Increases

A. A control cover sheet of the type described in U.S. Pat. No. 4,029,849 was prepared by coating the following layers, in the order recited, on a poly(ethylene terephthalate) film support:

(1) an acid layer comprising poly(n-butyl acrylate-co-acrylic acid) (30:70 weight ratio equivalent to 140 meq. acid/$m^2$);

(2) a timing layer comprising cellulose acetate (40 percent acetyl) at 4.0 g/$m^2$ and poly(styrene-co-maleic anhydride) at 0.26 g/$m^2$ containing 5-(2-cyanomethylthio)-1-phenyltetrazole at 110 mg/$m^2$; and (3) auxiliary timing layer of poly(acrylonitrile-co-vinylidene chloride-co-acrylic acid) latex in a (weight ratio of 14/79/7 coated at 2.2 g/$m^2$.

B. A cover sheet according to the invention was prepared by coating the following layers, in the order recited, on a poly(ethylene terephthalate) film support:

(1) an acid layer comprising poly(n-butyl acrylate-co-acrylic acid) (30:70 weight ratio equivalent to 140 meq. acid/$m^2$);

(2) a timing layer comprising 3.2 g/$m^2$ of a 1:1 physical mixture by weight of polyacrylonitrile-co-vinylidene chloride-co-acrylic acid) latex (weight ratio of 14/79/7) and a lactone polymer, partially hydrolyzed and 1-butanol transesterified poly(vinyl acetate-co-maleic anhydride), ratio of acid/butyl ester 15/85;

(3) a timing and addenda layer comprising cellulose acetate (40 percent acetyl) at 2.1 g/$m^2$, and poly(styrene-co-maleic anhydride) at 0.043 g/$m^2$ containing t-butyl-hydroquinone monoacetate (220 mg/$m^2$) and 5-(2-cyanomethylthio-1-phenyltetrazole (380 mg/$m^2$); and (4) auxiliary timing layer of poly(acrylonitrile-co-vinylidene chloride-co-acrylic acid) latex in a weight ratio of 14/79/7 coated at 1.1 g/$m^2$.

A portion of the imaging receiver element of Example 1 was exposed and processed as in Example 1, but using the cover sheets described above. The red, green and blue density of the resulting image is read after three hours. The densities of the same imaging element are read again after 72 hours (dark keeping at room temperature). The difference in density at D-max is a measure of the post-process dye diffusion. The following results were obtained:

| | | Sensitometry (three hours after transfer) | | | | | | | | | | | |
|---|---|---|---|---|---|---|---|---|---|---|---|---|---|
| | | D-min | | | D-max | | | D** | | | ΔD (3/72 hr)*** | | |
| Cover Sheet | TLB* | R | G | B | R | G | B | R | G | B | R | G | B |
| A (control) | 200 sec | 0.18 | 0.18 | 0.16 | 1.8 | 1.8 | 1.7 | 0.25 | 0.25 | 0.25 | +0.16 | +0.13 | +0.19 |
| B (control - different concentration) | 465 sec | 0.20 | 0.22 | 0.20 | 2.2 | 1.9 | 1.8 | 0.30 | 0.34 | 0.35 | +0.05 | +0.04 | +0.06 |
| C | 375 sec | 0.18 | 0.19 | 0.17 | 1.9 | 1.9 | 1.8 | 0.26 | 0.29 | 0.29 | +0.08 | +0.05 | +0.10 |
| D (no gel (interlayer) | 355 sec | 0.18 | 0.17 | 0.16 | 1.9 | 1.9 | 1.7 | 0.24 | 0.24 | 0.25 | +0.04 | +0.05 | +0.11 |

*TLB (timing layer breakdown) is the time required to reduce the pH to 10 of a simulated laminated film unit using a thymolphthalein indicator sheet and a cover sheet.

**D is the density 0.6 log E less exposure from a recorded density of 1.0. At these contrasts (approximately 1.7), it is an effective way to tabulate the presence of "soft toes".

***ΔD (3/72 hr) is the increase in maximum dye density observed between 3 and 72 hours after processing.

The above results indicate that cover sheets C and D according to the invention provide a significant improvement in minimizing 72-hour diffusion of all three dyes compared to the prior art control cover sheet A. While increasing the TLB in control cover sheet B by decreasing its coverage does minimize post-process dye diffusion, it has an unacceptable effect on sensitometry

| Cover Sheet | ΔD (3/72 hr)* | | |
|---|---|---|---|
| | Red | Green | Blue |
| A (control) | +0.10 | +0.07 | +0.09 |
| B | +0.02 | 0 | 0 |

*ΔD (3/72 hr) is the increase in maximum dye density observed between 3 and 72 hours after processing The above results indicate that the cover sheet according to the invention provides a significant improvement in minimizing 72 hours diffusion of all three dyes, compared to the prior art control cover sheet.

The invention has been described in detail with particular reference to preferred embodiments thereof, but it will be understood that variations and modifications can be effected within the spirit and scope of the invention.

What is claimed is:

1. In a photographic assemblage comprising:
(a) a support having thereon at least one photosensitive silver halide emulsion layer having associated therewith a dye image-providing material;
(b) a dye image-receiving layer;
(c) a neutralizing layer for neutralizing an alkaline processing composition;
(d) a first timing layer located between said neutralizing layer and said photosensitive silver halide emulsion layer; and
(e) a second timing layer located between said first timing layer and said neutralizing layer;
said first and second timing layers being so located that said processing composition must first permeate said timing layers before contacting said neutralizing layer, said neutralizing layer being located on the side of said second timing layer which is farthest from said dye image-receiving layer, the improvement wherein:
(i) said first timing layer contains photographic addenda for substantially terminating development of said silver halide emulsion layer; and
(ii) said second timing layer being capable of being permeated by said alkaline processing composition only after said silver halide development has been substantially terminated.

2. The assemblage of claim 1 wherein said photographic addenda is a development inhibitor.

3. The assemblage of claim 2 wherein said development inhibitor is a benzotriazole, a benzimidazole, an indazole, a mercaptothiazole, a mercaptooxazole, a mercaptodiazole, a mercaptothiadiazole, a mercaptopyrimidine, a mercaptobenzoxazole, a mercaptobenzimidazole or a mercaptotetrazole.

4. The assemblage of claim 1 wherein said second timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxyester-lactone.

5. In a photographic assemblage comprising:
(a) a support having thereon at least one photosensitive silver halide emulsion layer having associated therewith a dye image-providing material;
(b) a dye image-receiving layer;
(c) an alkaline processing composition and means for discharging same within said assemblage;
(d) a neutralizing layer for neutralizing said alkaline processing composition;
(e) a first timing layer located between said neutralizing layer and said photosensitive silver halide emulsion layer; and
(f) a second timing layer located between said first timing layer and said neutralizing layer;
said first and second timing layers being so located that said processing composition must first permeate said timing layers before contacting said neutralizing layer; said neutralizing layer being located on the side of said second timing layer which is farthest from said dye image-receiving layer, said assemblage containing a silver halide developing agent, the improvement wherein:
(i) said first timing layer contains photographic addenda for substantially terminating development of said silver halide emulsion layer; and
(ii) said second timing layer being capable of being permeated by said alkaline processing composition only after said silver halide development has been substantially terminated.

6. The assemblage of claim 5 wherein:
(a) said dye image-receiving layer is located between said support and said silver halide emulsion layer; and
(b) said assemblage also includes a transparent cover sheet over the layer outermost from said support.

7. The assemblage of claim 6 wherein said transparent cover sheet is coated with, in sequence, said neutralizing layer, said second timing layer and said first timing layer.

8. The assemblage of claim 7 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

9. The assemblage of claim 5 wherein said support having thereon said photosensitive silver halide emulsion layer is opaque, and said dye image-receiving layer is located on a separate transparent support superposed on the layer outermost from said opaque support.

10. The assemblage of claim 9 wherein said transparent support has thereon, in sequence, said neutralizing layer, said second timing layer, said first timing layer and said dye image-receiving layer.

11. The assemblage of claim 9 wherein said opaque support has thereon, in sequence, said neutralizing layer, said second timing layer, said first timing layer and said silver halide emulsion layer.

12. The assemblage of claim 5 wherein said dye image-providing material is a redox dye-releaser.

13. The assemblage of claim 5 wherein said dye image-providing material is a ballasted sulfonamido compound which is alkali-cleavable upon oxidation to release a diffusible color-providing moiety, said compound having the formula:

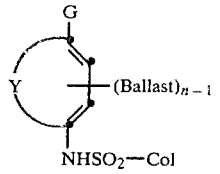

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR_2$ or $NHR_3$ wherein $R_2$ is hydrogen or a hydrolyzable moiety and $R_3$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR_2$ or when $R_3$ is hydrogen or an alkyl group of less than 8 carbon atoms.

14. An integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a red-sensitive, direct-positive silver halide emulsion layer having a ballasted redox cyan dye-releaser associated therewith; a green-sensitive, direct-positive silver halide emulsion layer having a ballasted redox magenta dye-releaser associated therewith; and a blue-sensitive, direct-positive silver halide emulsion layer having a ballasted redox yellow dye-releaser associated therewith;

(b) a transparent sheet superposed over said blue-sensitive silver halide emulsion layer and comprising a transparent support coated with, in sequence, a neutralizing layer, a second timing layer, and a first timing layer; and (c) a rupturable container containing an alkaline processing composition and an opacifying agent, said container being so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein:

(i) said first timing layer contains photographic addenda for substantially terminating development of each of said silver halide emulsion layers; and (ii) said second timing layer being capable of being permeated by said alkaline processing composition only after said silver halide development has been substantially terminated.

15. The assemblage of claim 14 wherein each said redox dye-releaser is a ballasted sulfonamido compound which is alkali-cleavable upon oxidation to release a diffusible color-providing moiety, said compound having the formula:

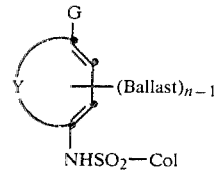

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR_2$ or $NHR_3$ wherein $R_2$ is hydrogen or a hydrolyzable moiety and $R_3$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR_2$ or when $R_3$ is hydrogen or an alkyl group of less than 8 carbon atoms.

16. The assemblage of claim 14 wherein said addenda is a development inhibitor.

17. The assemblage of claim 14 wherein each said silver halide emulsion is an internal-image silver halide emulsion and said second timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

18. In a process for producing a photographic transfer image in color from an imagewise-exposed photosensitive element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layers, said processing composition contacting said emulsion layer prior to contacting a neutralizing layer, whereby an imagewise distribution of dye image-providing material is formed as a function of development and at least a portion of it diffuses to a dye image-receiving layer to provide said transfer image, a first timing layer associated with said neutralizing layer being permeated by said alkaline processing composition after a predetermined time, said first timing layer being located between said neutralizing layer and said photosensitive silver halide emulsion layer, and a second timing layer associated with said neutralizing layer also being permeated by said alkaline processing composition after a predetermined time, said second timing layer being located between said first timing layer and said neutralizing layer, said first and second timing layers being so located that said processing composition must first permeate said timing layers before contacting said neutralizing layer, said neutralizing layer being located on the side of said second timing layer which is farthest from said dye image-receiving layer, whereby said alkaline processing composition is neutralized by means of said neutralizing layer associated with said timing layers after said predetermined times; the improvement which comprises:

(i) releasing photographic addenda from said first timing layer which will substantially terminate development of said silver halide emulsion layer; and (ii) permeating said second timing layer by said alkaline processing composition only after said silver halide development has been substantially terminated.

19. The process of claim 18 wherein said photographic addenda is a development inhibitor.

20. The process of claim 19 wherein said development inhibitor is a benzotriazole, a benzimidazole, an indazole, a mercaptothiazole, a mercaptooxazole, a mercaptodiazole, a mercaptothiadiazole, a mercaptopyrimidine, a mercaptobenzoxazole, a mercaptobenzimidazole or a mercaptotetrazole.

21. The process of claim 18 wherein said second timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

22. A dye image-receiving element adapted to be permeated by an alkaline processing composition comprising a support having thereon, in sequence, a neturalizing layer, a second timing layer, a first timing layer and a dye image-receiving layer, said first timing layer containing photographic addenda for substantially terminating development of a silver halide emulsion layer, and said second timing layer being capable of being permeated by said alkaline processing composition only after said silver halide development has been substantially terminated.

23. The element of claim 22 wherein said photographic addenda is a development inhibitor.

24. The element of claim 23 wherein said development inhibitor is a benzotriazole, 'a benzimidazole, an indazole, a mercaptothiazole, a mercaptooxazole, a mercaptodiazole, a mercaptothiadiazole, a mercaptopyrimidine, a mercaptobenzoxazole, a mercaptobenzimidazole or a mercaptotetrazole.

25. The element of claim 22 wherein said second timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

26. A photographic element adapted to be permeated by an alkaline processing composition comprising a support having thereon, in sequence, a neutralizing layer, a second timing layer, a first timing layer, and at least one photosensitive silver halide emulsion layer having associated therewith a dye image-providing material, said first timing layer containing photographic addenda for substantially terminating development of said silver halide emulsion layer, and said second timing layer being capable of being permeated by said alkaline processing composition only after said silver halide development has been substantially terminated.

27. The element of claim 26 wherein said photographic addenda is a development inhibitor.

28. The element of claim 27 wherein said development inhibitor is a benzotriazole, a benzimidazole, an indazole, a mercaptothiazole, a mercaptooxazole, a mercaptodiazole, a mercaptothiadiazole, amercaptopyrimidine, a mercaptobenzoxazole, a mercaptobenzimidazole or a mercaptotetrazole.

29. The element of claim 26 wherein said second timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

* * * * *